United States Patent [19]

Kerr

[11] 4,404,460

[45] Sep. 13, 1983

[54] CONTROLLABLY HEATED CLOTHING

[75] Inventor: John F. Kerr, Reseda, Calif.

[73] Assignee: Appleton Papers Inc., Appleton, Wis.

[21] Appl. No.: 357,404

[22] Filed: Mar. 12, 1982

[51] Int. Cl.[3] ..... H05B 1/00

[52] U.S. Cl. ..... 219/211; 2/69; 128/379; 128/402; 219/496; 219/529

[58] Field of Search ..... 219/211, 212, 486, 527, 219/528, 529, 545, 549, 496, 510; 128/379, 399, 400, 402; 2/69, 81, 2

[56] References Cited

U.S. PATENT DOCUMENTS

| | | | |
|---|---|---|---|
| 1,006,415 | 10/1911 | Stubling et al. | 219/211 X |
| 1,312,830 | 8/1919 | Camm | 219/211 |
| 1,358,509 | 11/1920 | Birkenfeld | 219/211 |
| 1,691,472 | 11/1928 | Graham et al. | 219/211 |
| 2,038,275 | 4/1936 | Fogg | 219/527 X |
| 2,277,772 | 3/1942 | Marrick | 219/211 |
| 2,329,766 | 9/1942 | Jacobson | 219/211 |
| 2,339,409 | 1/1944 | Joy et al. | 219/527 |
| 2,433,476 | 12/1947 | Munschak | 219/211 |
| 2,458,119 | 1/1949 | Van Daam | 219/211 |
| 2,692,326 | 10/1954 | Crowell | 219/211 |
| 2,718,584 | 9/1955 | Hariu | 219/211 |
| 3,084,241 | 4/1963 | Carrona | 219/211 |
| 3,134,891 | 5/1964 | Hyer | 219/211 |
| 3,367,319 | 2/1968 | Carter, Jr. | 219/211 X |
| 3,657,515 | 4/1972 | Smith | 219/211 |
| 3,663,797 | 5/1972 | Marsh | 219/211 |
| 3,783,240 | 1/1974 | Drummond, Jr. | 219/486 |
| 3,858,028 | 12/1974 | Kerr | 219/211 |
| 3,999,037 | 12/1976 | Metcalf, Sr. | 219/211 |
| 4,087,675 | 5/1978 | Sansonetti | 219/211 |

FOREIGN PATENT DOCUMENTS

| | | | |
|---|---|---|---|
| 545812 | 7/1942 | United Kingdom | 219/211 |

*Primary Examiner*—Volodymyr Y. Mayewsky
*Attorney, Agent, or Firm*—E. Frank McKinney; Paul S. Phillips, Jr.

[57] ABSTRACT

Heated clothing includes:

(a) multiple clothing sections adapted to cover different portions of the human body, (b) electrical wires carried by such sections and including bus wires and heater wires, and (c) circuitry for controlling battery powered electrical current flow to such wires, and including switch structure connected in series with one or more of the heater wires for interrupting current flow thereto without requiring disconnection of bus wires.

11 Claims, 10 Drawing Figures

FIG. 2.
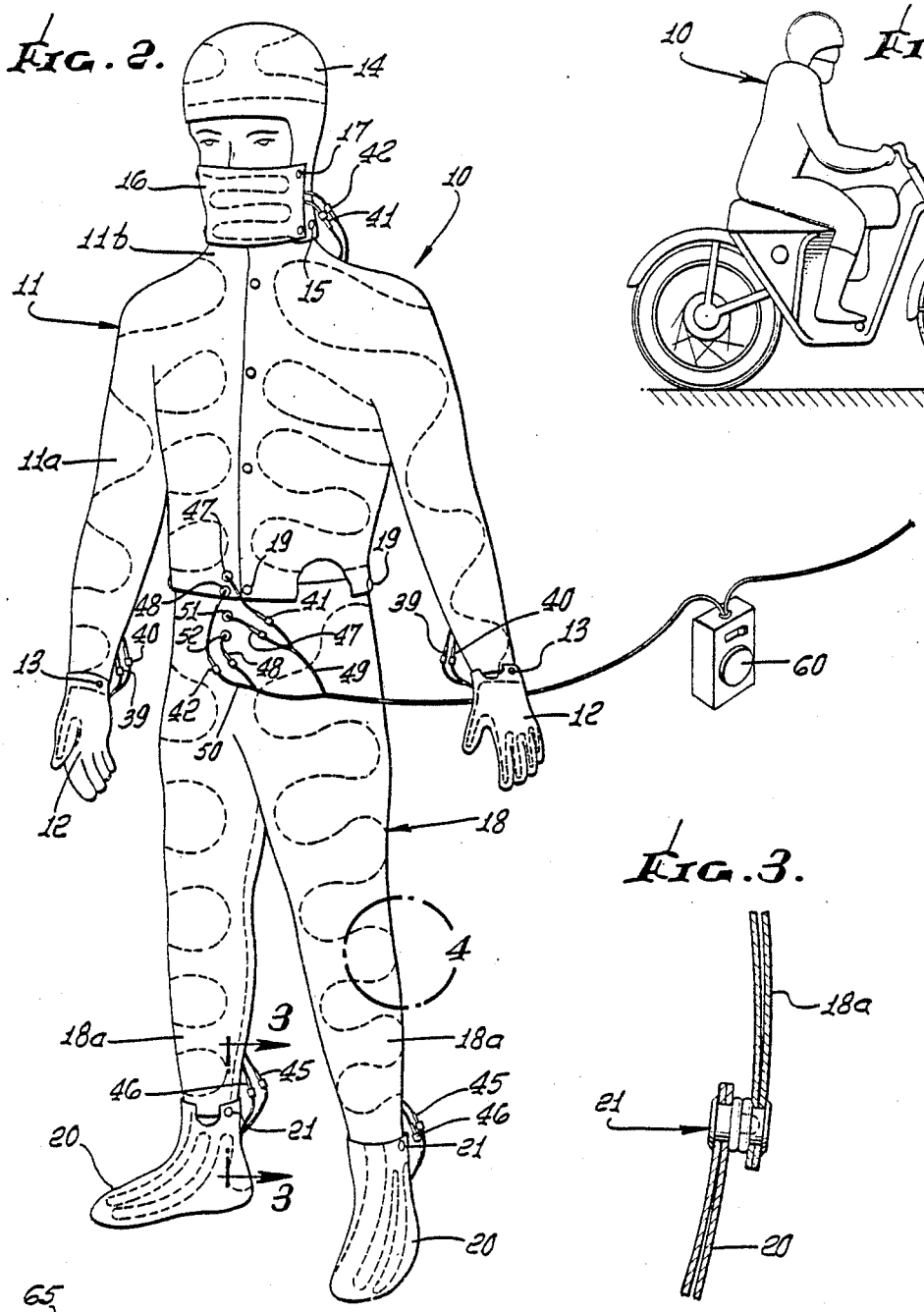
FIG. 1.
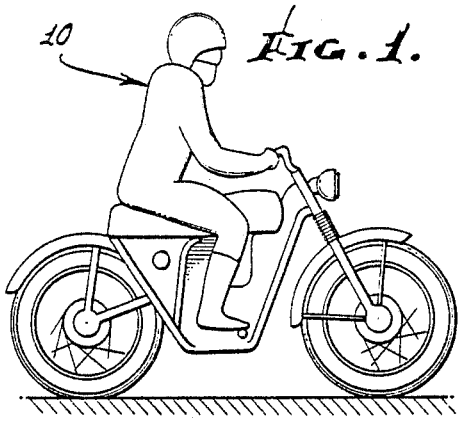
FIG. 3.
FIG. 4.
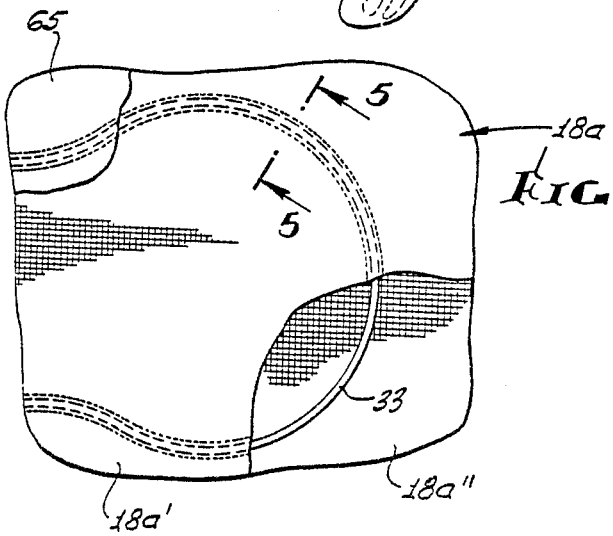
FIG. 5.
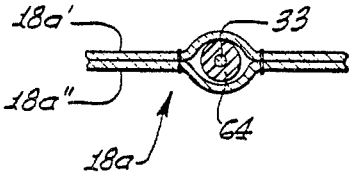

FIG. 6.
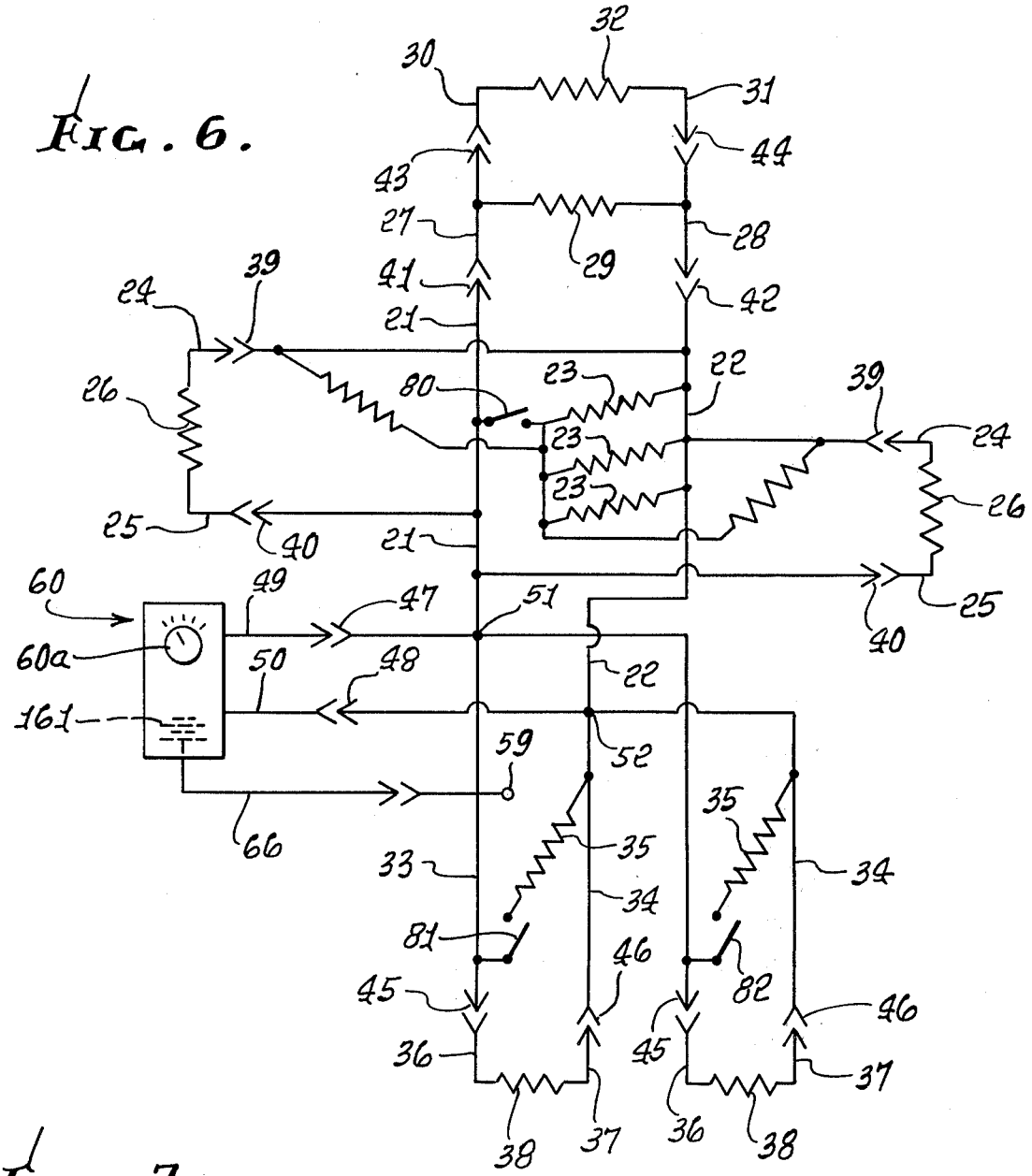
FIG. 7.
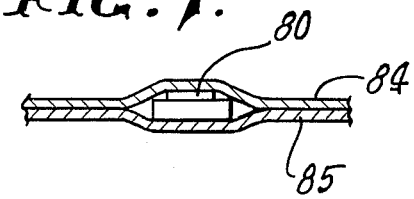
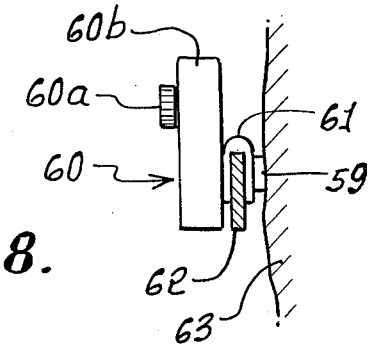
FIG. 8.

CONTROLLABLY HEATED CLOTHING

BACKGROUND OF THE INVENTION

This invention relates generally to heated clothing, and more particularly concerns a heated suit system which is modular and which enables selective wearing of certain sections of the suit without impairment of the heating function.

There is a need for heated garments in many sports and other activities, such as for example, motorcycling, snowmobile operation and the operation of construction equipment out of doors in cold climates. On the other hand, a complete heated suit may become locally uncomfortable to the wearer, to the extent that he requires heating of only a selected portion of a complete suit.

One heated suit of interest is that described in my prior U.S. Pat. No. 3,858,028. While that suit has many advantages, it is found that conservation of electrical energy supplied to the heater wires is desirable, for example to prolong the life of a battery power supply to enable use of the suit for longer periods without battery charging. Also, control of heating in relation to existing temperature at a garment zone or zones adjacent the wearer's body is desired, to conserve energy and to avoid overheating or unnecessary heating of certain suit zones.

SUMMARY OF THE INVENTION

It is a major object of the invention to provide a heated suit system, including controls, to fulfill needs as referred to, including conservation of energy. Basically, the suit and control comprises (a) multiple clothing sections adapted to cover different portions of the human body, (b) electrical wires carried by said sections, and including bus wires and heater wires, and (c) means for controlling battery powered electrical current flow to said wires, and including switch means connected in series with one or more of said heater wires for interrupting current flow thereto without requiring disconnection of bus wires.

As will appear one or more heater wires may be carried by clothing sections adapted to cover the wearer's trunk, legs, feet, arms, hands, head and face; and the switch means may include:

(i) a first switch connected in series with said one or more heater wires carried by a clothing section defining a jacket, (ii) second and third switches respectively connected with heater wires carried by clothing sections defining trousers.

In this regard, the use of such switch means is such that electric current may continue to be supplied to heater wires at body extremeties (tending to sense cold to greater extent than the wearer's trunk and legs) while current is controllably supplied to, or cut-off from, heater wires proximate the wearer's trunk and legs.

As will further appear, a temperature sensor may be carried by the wearer to sense wearer's body heating of the clothing, said sensor connected in controlling relation with said temperature control to cause an increase in current flow to said wires in response to a predetermined lowering of sensed body generated heating of the clothing. The control itself may include:

($x_1$) a comparator having two control inputs one of which is electrically connected with said sensor, and the other of which is electrically connected with an adjustable voltage source, and ($x_2$) circuitry responsive to the comparator output to control current flow to said wires.

These and other objects and advantages of the invention, as well as the details of an illustrative embodiment, will be more fully understood from the following specification and drawings, in which:

DRAWING DESCRIPTION

FIG. 1 is a side elevation showing a sportsman whose suit embodies the invention;

FIG. 2 is a showing of the FIG. 1 suit, with same wiring details illustrated;

FIG. 3 is an enlarged section on line 3—3 of FIG. 2;

FIG. 4 is an enlarged fragmentary section, partly broken away, on line 4—4 of FIG. 2;

FIG. 5 is an enlarged cross-section on line 5—5 of FIG. 4;

FIG. 6 is a wiring diagram;

FIG. 7 is an enlarged section showing concealment of a switch;

FIG. 8 is a section showing location of a temperature sensor adjacent the wearer's clothing.

DETAILED DESCRIPTION

Figure 9:
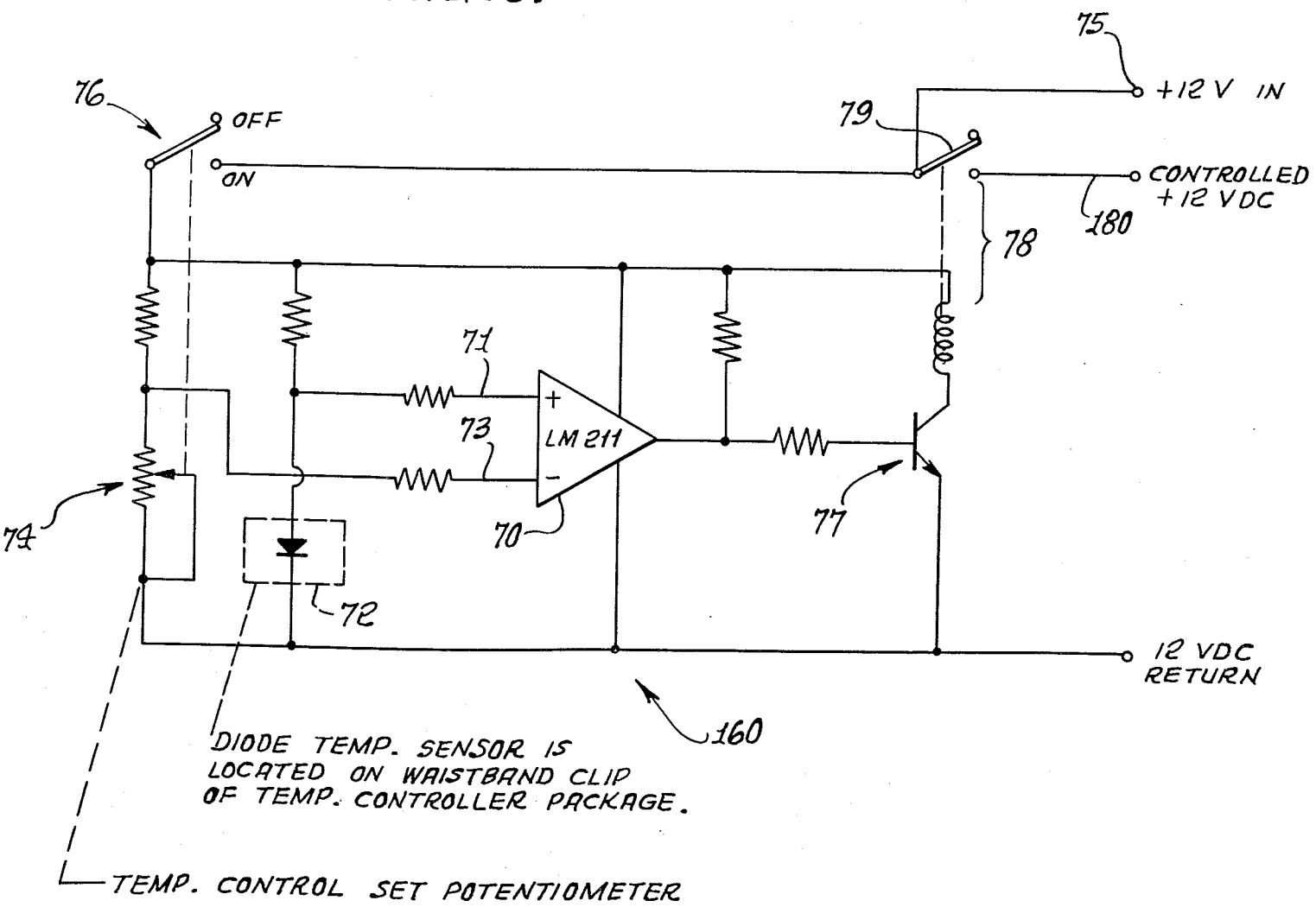
FIGS. 9 and 10 are circuit diagrams.

In the drawings, the suit 10 comprises multiple clothing sections each adapted to cover a different portion of the human body. For example, the suit 10 includes a jacket 11 to the arms 11*a* of which gloves 12 are attached as by snap fasteners 13, and to the neck 11*b* of which a hood 14 is attached as by snap fasteners 15. Also, a face mask 16 is attached to the hood as by snap fasteners 17. The suit also includes trousers 18 having snap fastener attachment to the jacket at 19; and slippers 20 having snap fastener attachment to the trouser legs 18*a* at 21. The latter are shown in detail in FIG. 3, although other forms of fasteners may be employed.

Electrical wires are carried by each clothing section, and include bus wires and heater wires connected therewith (as for example between the bus wires). This is tabulated as follows, with added reference to FIG. 6:

| Clothing Section | Bus Wires | Heater Wires |
|---|---|---|
| jacket 11 | 21, 22 | 23 |
| gloves 12 | 24, 25 | 26 |
| hood 14 | 27, 28 | 29 |
| face mask 16 | 30, 31 | 32 |
| trousers 18 | 33, 34 | 35 |
| slippers 20 | 36, 37 | 38 |

In addition, separable electrical connections are established between the bus wires of adjacent clothing sections, as tabulated as follows:

| Adjacent bus wire | Separable connectors |
|---|---|
| 22 & 24 | 39 |
| 21 & 25 | 40 |
| 21 & 27 | 41 |
| 22 & 28 | 42 |
| 27 & 30 | 43 |
| 28 & 31 | 44 |
| 33 & 36 | 45 |
| 34 & 37 | 46 |

Further, input electrical connections are established to the bus wires of at least one of the clothing sections, and in the drawings such input connections are established at 47 and 48 between input leads 49 and 50 and junctions 51 and 52. Buses 21 and 33 are connected to junction 51, and buses 22 and 34 are connected to junction 52. The separable connectors are of releasable plug type, so that various of the connections 39 and 40, 41 and 42, 43 and 44, and 45 and 46 may be unplugged to prevent heating of the associated clothing elements.

In accordance with an important aspect of the invention, the means for controlling current flow to the heater wires includes switch means connected in series with one or more of the heater wires for controllably interrupting current flow thereto, without requiring disconnection from the bus wires. In the illustrated embodiment, the switch means includes a first switch (as at 80) connected in series with one or more heater wires (as for example jacket heater wires 23) so that to conserve electrical energy the switch 80 may be opened at certain times while current is being delivered to the heater wires associated with the face mask, or hood or gloves (i.e. at body extremities more susceptible to cold than the jacket covered trunk of the wearer or user). Further, second and third switches 81 and 82 may be respectively connected in series with heater wires (as for example trouser heater wires 35) so that to conserve electrical energy one or both switches 81 and 82 may be opened at certain times while current is being delivered to the heater wires 38 associated with the slippers, i.e. to warm the user's feet. The switches 80, 81 and 82 may be protectively located in the clothing, and operated by merely pushing on that area of the clothing. See for example push button switch 80 in FIG. 7, with clothing layers 84 and 85 covering same. Switch may be located at or near the rear collar of the jacket; and switches 81 and 82 at either side of or near the trouser knees.

A current control is provided as at 60 in series with input leads 49 and 50 to control the power or current supplied to the suit so as to vary the heating as required by the number of clothing sections remaining electrically connected with the input leads, as described. An AC or DC power source is indicated at 161, and may for example comprise a battery. Merely as illustrative, a fully operating suit will draw between 1 to 1.5 amperes at about 12 volts.

The wires (bus and heater or resistance) may be embedded between clothing layers, as indicated in FIGS. 4 and 5 where bus wire 33 extends between trouser leg layers 18*a*′ and 18*a*″. Note that insulation 64 may surround the bus wire, and this construction may also be employed throughout. The clothing may comprise a liner for outer clothing or it may comprise the main garment, with an insulative outer layer as at 65 in FIG. 4.

The plug-in type connectors may include plugs and receptacles, with snap or screw-in retention. One commercial type connector is a product of E. F. Johnson Company, and bears jack and plug numbers 108-09-02-001, 108-0903-001, 108-0302-001, and 108-03-02-001.

From the above, it is clear that the invention provides very simple and advantageous selectively wearable clothing sections which are selectively heated in response to electrical interconnection of the clothing sections.

In accordance with a further aspect of the invention, a temperature sensor is or may be provided to be carried by the wearer in such closeness to the clothing as to sense wearer's body generated heating of the clothing. See sensor 59 (thermistor or diode for example) carried by a clip 61 attachable to the wearer's belt 62 to contact the clothing 63, in FIG. 8. The sensor is electrically connected in controlling relation with the temperature control 60 to cause an increase in current supply to the junction 52 and heater wires in response to a predetermined lowering of sensed body generated heating of the clothing. If the latter is excessive, the sensor 59 and control 60 cause a reduction of current supply to the junction 52. Control 60 includes a case 60*b* which may be carried by the clip 61, as shown in FIG. 8. Control 60 includes a knob 60*a* to control a potentiometer, as will appear, for manual adjustment of heating level.

More specifically, the control 60 typically includes a comparator having two control inputs, one of which is electrically connected with the sensor 59 (see input lead 66 in FIG. 6), and the other of which is connected with an adjustable voltage source controlled by knob 60*a*. Circuitry is also provided in the control 60 to be responsive to the comparator output to control current flow to the heater wires, in the manner described above.

FIG. 9 illustrates circuit DC details of a heating temperature controller 160 (corresponding to control 60 described above). Comparator 70 has a first input 71 connected with the diode 72 serving as a body heat temperature sensor (see sensor 59 above). The second input 73 to the comparator is connected with the manually adjustable potentiometer 74. Both 72 and 74 are connected with a 12 volt battery supply via terminal 75 and ON-OFF switch 76. The comparator output controls the gate of transistor 77. When the latter conducts, relay 78 operates to connect the 12 volts supply to the heater wires via closed switch arm 79 and lead 180.

Figure 10:
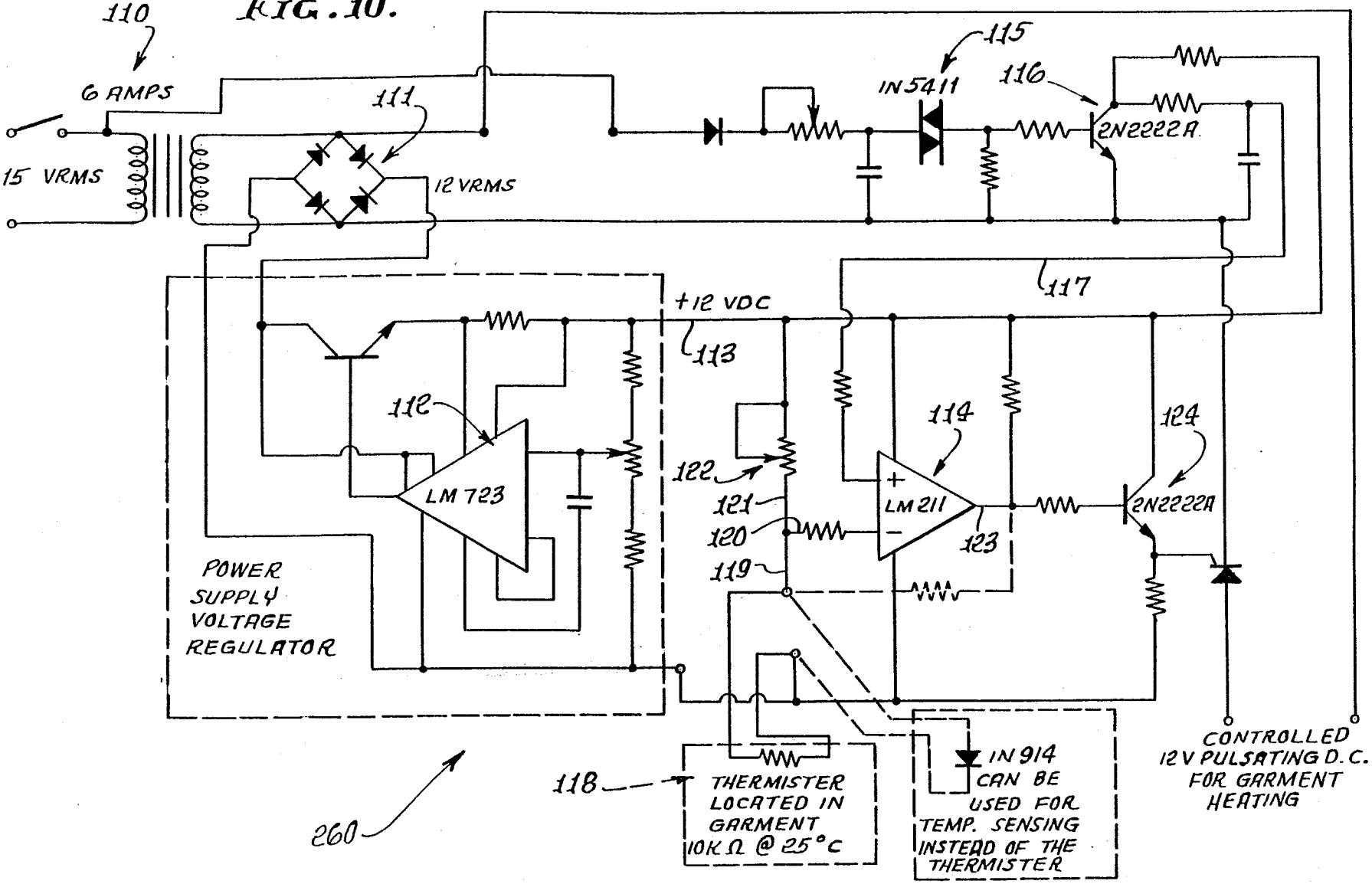

FIG. 10 illustrates AC circuit details of a modified temperature controller 260, which may be remote from the heated garment.

Power is supplied via the transformer 110 from an AC wall outlet. A bridge rectifier 111 and LM723 regulator 112 supply lead 113 with the 12 volts DC for operating the LM211 comparator 114.

A ramp is generated by the IN5411 DIAC 115 and the 2N2222A transistor 116. The ramp is applied via lead 117 to the non-inverting input of the LM211 comparator. A thermister 118 controlled voltage is applied at 119 to the inverting input 120 of the comparator. Control input is supplied at 121 by potentiometer 122. When the ramp voltage exceeds the level of control voltage, there will be a pulse at the output 123 of the comparator, which will be applied to the gate of the SCR124. The ramp being synchronized with the AC line frequency will cause the SCR to conduct for some portion of the positive AC cycle. The number of degrees of cycle conduction will depend on how much the ramp voltage peak exceeds the control voltage level. When the two are of equal amplitude there will be no conduction. Note that the thermister 118 can be replaced with a 1N914 silicon diode, if desired.

I claim:

1. In heated clothing, the combination comprising (a) multiple clothing sections adapted to cover different portions of the human body, (b) electrical wires carried by said sections and including bus wires and heater wires, said bus and heater wires being electrically insulated, and (c) means including a temperature control connected in series with said wires for controlling battery powered electrical current flow to said bus and heater wires, and including manually operable switch means connected in series with at least one of said heater wires for interrupting current flow thereto without requiring disconnection of bus wires, (d) there being a temperature sensor adapted to be carried by the wearer of the clothing to sense wearer's body heating of the clothing, said sensor connected in controlling relation with said temperature control to cause an increase in current flow to said wires in response to a predetermined lowering of sensed body generated heating of the clothing, (e) and structure to contain said control and to attach the control to the wearer's clothing with the sensor carried by said structure to be exposed toward the wearer's body.

2. The combination of claim 1 wherein said heater wires are carried by clothing sections adapted to cover portions of the trunk of the human body.

3. The combination of claim 2 wherein said heater wires are also carried by clothing sections adapted to cover portions of legs of the human body.

4. The combination of claim 1 wherein said heater wires are carried by clothing sections adapted to cover portions of legs of the human body.

5. The combination of claim 1 wherein said switch means include (i) a first switch connected in series with at least one heater wire carried by a clothing section defining a jacket, (ii) second and third switches respectively connected with heater wires carried by clothing sections defining trousers.

6. The combination of claim 5 wherein other clothing sections carrying heater wires include at least one of the following:-

(iii) a sleeve (iv) a glove (v) a hood (vi) a face mask (vii) a slipper.

7. The combination of claim 1 wherein said heater wires are connected across electrically parallel bus wires.

8. In heated clothing, the combination comprising (a) multiple clothing sections adapted to cover different portions of the human body, said sections being of electrically non-conductive material, (b) electrical wires carried by said sections and including bus wires and heater wires, said bus and heater wires being electrically insulated, and (c) means including a temperature control connected in series with said wires for controlling battery powered electrical current flow to said bus and heater wires, and including manually operable switch means connected in series with at least one of said heater wires for interrupting current flow thereto without requiring disconnection of bus wires, (d) there being a temperature sensor adapted to be carried by the wearer of the clothing to sense wearer's body heating of the clothing, said sensor connected in controlling relation with said temperature control to cause an increase in current flow to said wires in response to a predetermined lowering of sensed body generated heating of the clothing, (e) and including a case for said control, a clip on the case to attach to the wearer's clothing, and said sensor carried by the clip to be exposed toward the wearer's body.

9. In heated clothing, the combination comprising (a) multiple clothing sections adapted to cover different portions of the human body, (b) electrical wires carried by said sections and including bus wires and heater wires, said bus and heater wires being electrically insulated, and (c) means including a temperature control connected in series with said wires for controlling battery powered electrical current flow to said bus and heater wires, and including manually operable switch means connected in series with at least one of said heater wires for interrupting current flow thereto without requiring disconnection of bus wires, (d) there being a temperature sensor adapted to be carried by the wearer of the clothing to sense wearer's body heating of the clothing, said sensor connected in controlling relation with said temperature control to cause an increase in current flow to said wires in response to a predetermined lowering of sensed body generated heating of the clothing, (e) said (c) means including:

($x_1$) a comparator having two control inputs one of which is electrically connected with said sensor, and the other of which is electrically connected with an adjustable voltage source, and ($x_2$) circuitry responsive to the comparator output to control current flow to said wires.

10. In heated clothing, the combination comprising (a) multiple clothing sections adapted to cover different portions of the human body, (b) electrical wires carried by said sections and including bus wires and heater wires, said wires being electrically insulated, and (c) a temperature control connected in series with said wires, and (d) a temperature sensor adapted to be carried by the wearer of the clothing to sense wearer's body heating of the clothing, said sensor connected in controlling relation with said temperature control to cause an increase in current flow to said wires in response to a predetermined lowering of sensed body generated heating of the clothing, (e) and including a case for said control, a clip on the case to attach to the wearer's clothing, and said sensor carried by the clip to be exposed toward the wearer's body.

11. The combination of claim 10 wherein said control includes ($x_1$) a comparator having two controls inputs one of which is electrically connected with said sensor, and the other of which is electrically connected with an adjustable voltage source, and ($x_2$) circuitry responsive to the comparator output to control current flow to said wires.

* * * * *

UNITED STATES PATENT AND TRADEMARK OFFICE

CERTIFICATE OF CORRECTION

PATENT NO. : 4,404,460

DATED : September 13, 1983

INVENTOR(S) : John F. Kerr

It is certified that error appears in the above-identified patent and that said Letters Patent are hereby corrected as shown below:

On summary page at [73] after Assignee: delete "Appleton Papers Inc., Appleton, Wis."

Signed and Sealed this

*Twenty-second* Day of *January 1985*

[SEAL]

*Attest:*

DONALD J. QUIGG

*Attesting Officer* *Acting Commissioner of Patents and Trademarks*